US009868093B2

(12) United States Patent
Bridson

(10) Patent No.: US 9,868,093 B2
(45) Date of Patent: Jan. 16, 2018

(54) FLOTATION MACHINE ROTOR

(76) Inventor: Roger Farnworth Bridson, Mooral Creek (AU)

( * ) Notice: Subject to any disclaimer, the term of this patent is extended or adjusted under 35 U.S.C. 154(b) by 399 days.

(21) Appl. No.: 13/581,839

(22) PCT Filed: Mar. 1, 2011

(86) PCT No.: PCT/AU2011/000224
§ 371 (c)(1),
(2), (4) Date: Oct. 9, 2012

(87) PCT Pub. No.: WO2011/106828
PCT Pub. Date: Sep. 9, 2011

(65) Prior Publication Data

US 2013/0020400 A1 Jan. 24, 2013

(30) Foreign Application Priority Data

Mar. 1, 2010 (ZA) ..... 2010/01465

(51) Int. Cl.
*B03D 1/16* (2006.01)
*B01F 3/04* (2006.01)
(Continued)

(52) U.S. Cl.
CPC ..... *B01F 3/04539* (2013.01); *B01F 3/04617* (2013.01); *B01F 7/1635* (2013.01); *B03D 1/1412* (2013.01); *B03D 1/16* (2013.01); *B03D 1/20* (2013.01); *B01F 2003/04546* (2013.01); *B01F 2003/04652* (2013.01); *B01F 2003/04687* (2013.01)

(58) Field of Classification Search
USPC ..... 209/164, 169
See application file for complete search history.

(56) References Cited

U.S. PATENT DOCUMENTS 1,413,723 A * 4/1922 Groch ..... 209/169
2,115,997 A * 5/1938 Morse ..... 209/169
(Continued)

FOREIGN PATENT DOCUMENTS

CN 2129175 Y 4/1993
CN 1443094 A 9/2003
DE 205082 * 12/1983

OTHER PUBLICATIONS

International Search Report, International Application No. PCT/AU2011/000224, dated Apr. 8, 2011.
(Continued)

*Primary Examiner* — Thomas M Lithgow
(74) *Attorney, Agent, or Firm* — Hoffman & Baron, LLP

(57) ABSTRACT

A rotor for use in a slurry separation flotation cell having a tank within which the rotor is contained. The rotor has a shaft that has a conduit adapted to communicate a fluid, preferably a gas such as air, therethrough. The rotor also has impeller blades extending radially from the shaft and a baffle adjacent the bottom of the impeller blades. The baffle extends from an end of the shaft to at or near an outer edge of the impeller blades, directing the gas to the outer edges of the impeller blades for dispersion into the slurry. The rotor is located adjacent a floor of the tank and, in use, draws slurry downwards into the impeller portion and forces it outwards with the gas being mixed therein.

10 Claims, 2 Drawing Sheets

(51) Int. Cl.

| | |
|---|---|
| ***B01F 7/16*** | (2006.01) |
| ***B03D 1/14*** | (2006.01) |
| ***B03D 1/20*** | (2006.01) |

(56) References Cited

U.S. PATENT DOCUMENTS

| | | | | | |
|---|---|---|---|---|---|
| 2,232,388 | A * | 2/1941 | Ingalls et al. | | 209/169 |
| 2,393,976 | A * | 2/1946 | Daman et al. | | 209/169 |
| 2,651,413 | A * | 9/1953 | Daman | | 209/168 |
| 2,767,965 | A * | 10/1956 | Daman | | 261/87 |
| 4,311,240 | A * | 1/1982 | Auerbach | B03D 1/16 | 209/169 |
| 4,425,232 | A * | 1/1984 | Lawrence et al. | | 210/219 |
| 4,692,244 | A * | 9/1987 | Supp | B01F 7/1675 | 210/219 |
| 4,959,183 | A * | 9/1990 | Jameson | B01F 3/04539 | 209/169 |
| 6,308,834 | B1 * | 10/2001 | Peaker et al. | | 209/169 |
| 6,799,683 | B2 | 10/2004 | Jounela et al. | | |
| 6,991,111 | B2 | 1/2006 | Lilja et al. | | |
| 7,404,924 | B2 * | 7/2008 | Letelier | | 266/170 |

OTHER PUBLICATIONS

International Preliminary Report on Patentability International Application No. PCT/AU2011/000224 dated Dec. 7, 2011.

* cited by examiner

FLOTATION MACHINE ROTOR

CROSS-REFERENCE TO RELATED APPLICATIONS

This application is the National Stage of International Application No. PCT/AU2011/000224, filed Mar. 1, 2011, which claims the benefit of South Africa Application No. 2010/01465, filed Mar. 1, 2010, the entire contents of both of which are incorporated by reference herein.

FIELD OF THE INVENTION

The invention relates to flotation machine and, in particular, to a flotation machine rotor for use in a flotation cell.

BACKGROUND TO THE INVENTION

Flotation apparatus, often called flotation machines or flotation cells, are commonly employed to separate solid material (e.g. ore) from slurry, which is typically composed of liquids and solids in varying proportions. A flotation machine usually has a tank with a rotor therein and some form of gas delivery system. In use, the rotor rotates and agitates slurry in the tank dispersing gas, from the gas delivery system, thereby causing the formation of gas bubbles.

Typically the slurry comprises at least a hydrophobic material which is separated from the slurry by adhering to the gas bubbles, floating to the surface, and forming a froth at the surface that has a higher concentration of the adhered material than the slurry. The froth, being a combination of liquid, solid particles, and gas, is then removed for further processing.

The gas bubble to particle interaction is important to the process as without it, there can be no separation using the described flotation method. The rotor is considered to be one of the most important aspects of the flotation machine, and in achieving the gas bubble to particle interaction, as the other components merely react to the movement of the rotor.

There are three functions in particular which the flotation machine should achieve. The first is solid suspension. Virtually all flotation machine installations are utilized for the separation of slurry and, according, it is vital that the solids are kept suspended within the liquid because otherwise the gas bubbles cannot collide with the particles to carry them upward. Furthermore, if the solids build up to any degree, the volume of the cell is reduced and retention times and short circuiting can occur. A build up of solids can also eventually overwhelm the rotor and stop the cell from working altogether.

The second function is air dispersion. The amount of energy required to suspend solids is considerably less than it is to disperse air. For example, a typical flotation machine would use 300 kW to process a 300 $m^3$ tank, with the suspension of a typical slurry estimated to require only a 30 kW portion of that power.

Finally, the third function is circulation. The contents of the flotation cell have to be well circulated to ensure that solid particles come into contact with the dispersed gas as often as possible. This ensures the solid particles have ample opportunity to adhere to the gas bubbles, and consequently assists in getting optimal recovery of the solid material.

Known flotation cells have a rotor with impeller blades located inside a tank within which the slurry is received and processed. The rotor typically has a hollow shaft which transports a gas to an outlet located on or near the rotor. A horizontal baffle plate is typically located at or near the top of the impeller blades to disperse the gas across the width of the rotor. The impeller blades are typically curved in profile, following an arc tending towards the axis of rotation of the rotor such that the rotor has a smaller diameter at the bottom than at the top.

There are many disadvantages associated with these rotor arrangements, resulting in reduced performance and efficiency. For example, the gas leaves the shaft, and enters the slurry under the rotor baffle plate where it travels horizontally underneath the baffle plate to its perimeter. At the periphery of the baffle plate the air mixes with the slurry in a high shear contact region. As this region is only at the top of the rotor blades, after which the gas typically travels upwards away from the rotor, it is relatively small. This inefficiently disperses the gas in the slurry, also often resulting in irregular bubble sizes as large amounts of the gas can escape the high shear zone and form bubbles that are too large to adhere to solid particles.

Furthermore, the baffle plate on top of the impeller blades prevents vertical movement of flows into the rotor and, therefore, circulation in the tank is limited, particularly above the baffle plate. In order to try to overcome this problem, some attempts have been made to introduce further impeller blades half way up the shaft of the rotor.

A common problem in flotation cells of the above design is 'sanding'. Sanding occurs when the solids collect and build up at the bottom of the tank in a stagnant, or at least very slow moving, layer. Some attempts have been made to reduce sanding problems by increasing agitation above and below the rotor, such as using a guiding element half way down the impeller blades to simultaneously suck the slurry up (from the bottom) and down (from above the rotor): This improves some of the mentioned issues, such as improving circulation above the rotor. However, sanding can still occur as the suction from below has regions of low or no activity that is bypassed by the slurry flow.

These problems, among others, significantly reduce the efficiency and effectiveness of a flotation cell. This increases costs in operating the cell, and reduces the recovery rate of the desirable solids from the slurry.

OBJECT OF THE INVENTION

It is an aim of this invention to provide a flotation machine rotor which overcomes or ameliorates one or more of the disadvantages or problems described above, or which at least provides a useful alternative.

SUMMARY OF INVENTION

According to a first aspect of the invention, there is provided A rotor for use in a flotation cell having a tank with the rotor contained therein in use, the rotor comprising:

a shaft having a conduit adapted to communicate a fluid therethrough;

an impeller having a series of impeller blades that extend outwardly around the shaft; and a baffle located adjacent the bottom of the impeller, the baffle extending transversely with respect to the shaft and extending at least substantially the width of the impeller;

wherein the conduit has an outlet located below the baffle.

The impeller blades preferably extend from the shaft, and the rotor is preferably configured to allow the fluid to flow from a source through the conduit to the outlet to be dispersed into the tank adjacent a lower outer edge of the impeller blades.

A portion of the impeller blade, preferably a minority portion, may extend below the baffle. This portion may take the form of an expeller member, and may substantially perform the function of a scraper. Alternatively, the baffle may engage with a lower edge of the impeller blades. One or more expeller members, which may or may not correspond with impeller blades may then also be provided on the underside of the baffle.

The baffle may also be stationary relative to the rotor, being affixed to an inner surface of the tank.

The baffle is preferably affixed to at least one of: the shaft and one or more of the rotor blades. The baffle is preferably substantially planar, and preferably a circular plate element. The baffle may have one or more apertures.

The impeller blades preferably define an impeller having a constant diameter over the axial axis of the rotor. In a preferred form, each impeller blade is substantially rectangular.

Preferably, the shaft defines the conduit. In particular, the shaft is preferably hollow forming the conduit.

According to a second aspect of the invention, there is provided a flotation tank assembly comprising:

a tank having a floor and at least one side wall together defining a cavity; and a rotor according to any one of the preceding claims.

Preferably, the rotor is located adjacent the floor of the tank. In a form of the invention the rotor is directly adjacent the floor, with only sufficient clearance underneath to allow suitable rotation of the rotor:

According to a third aspect of the invention, there is provided a method of dispersing a fluid into a slurry in a floatation cell, the method comprising the steps of:

rotating a rotor within a tank containing slurry, the rotor having:

a shaft that has a conduit adapted to communicate a fluid therethrough;

an impeller having a series of impeller blades that extend outwardly around the shaft; and at least one baffle adjacent the bottom of the impeller, the baffle extending transversely with respect to the shaft and extending at least substantially the width of the impeller;

feeding a fluid through the conduit to an outlet below the baffle; and dispersing the fluid from the outlet adjacent a lower outer edge of the impeller blades.

The rotor is preferably located adjacent a floor of the tank, and the fluid preferably is dispersed at a peripheral edge of the baffle below a majority portion of the impeller blades.

In all of the aspects, the fluid is preferably a gas, such as air, which is dispersed in the slurry to form gas bubbles which rise to the surface of the tank with solids adhered thereto. Once at, or near, the surface, the bubbles are removed and processed to recover the solids.

The rotor is preferably made of a metal, e.g. steel. Even more preferably, particularly for slurry application, the rotor components are coated with a wear resistant coating. The wear resistant coating may be polyurethane or rubber.

A flotation rotor kit may be provided, the kit being for assembling a flotation rotor within a pre-existing tank, the rotor kit comprising:

a shaft that has a conduit adapted to communicate a fluid therethrough;

impeller blades configured to extend from the shaft substantially perpendicular to the shaft axis; and at least one baffle configured to be located adjacent the bottom of the impeller blades, the baffle extending substantially perpendicularly from an end of the shaft to at or near an outer edge of the impeller blades in use;

wherein the conduit has an outlet configured to release the fluid below the baffle in use.

A method of installing the flotation rotor kit may also be provided, wherein the method comprises installing the rotor kit such that the baffle is adjacent a floor of the tank.

Further features and advantages of the present invention will become apparent from the following detailed description.

BRIEF DESCRIPTION OF THE DRAWINGS

To assist in understanding the invention and to enable a person skilled in the art to put the invention into practical effect, preferred embodiments of the invention will be described by way of example only with reference to the accompanying drawings, in which.

DETAILED DESCRIPTION OF THE DRAWINGS

Figure 1:
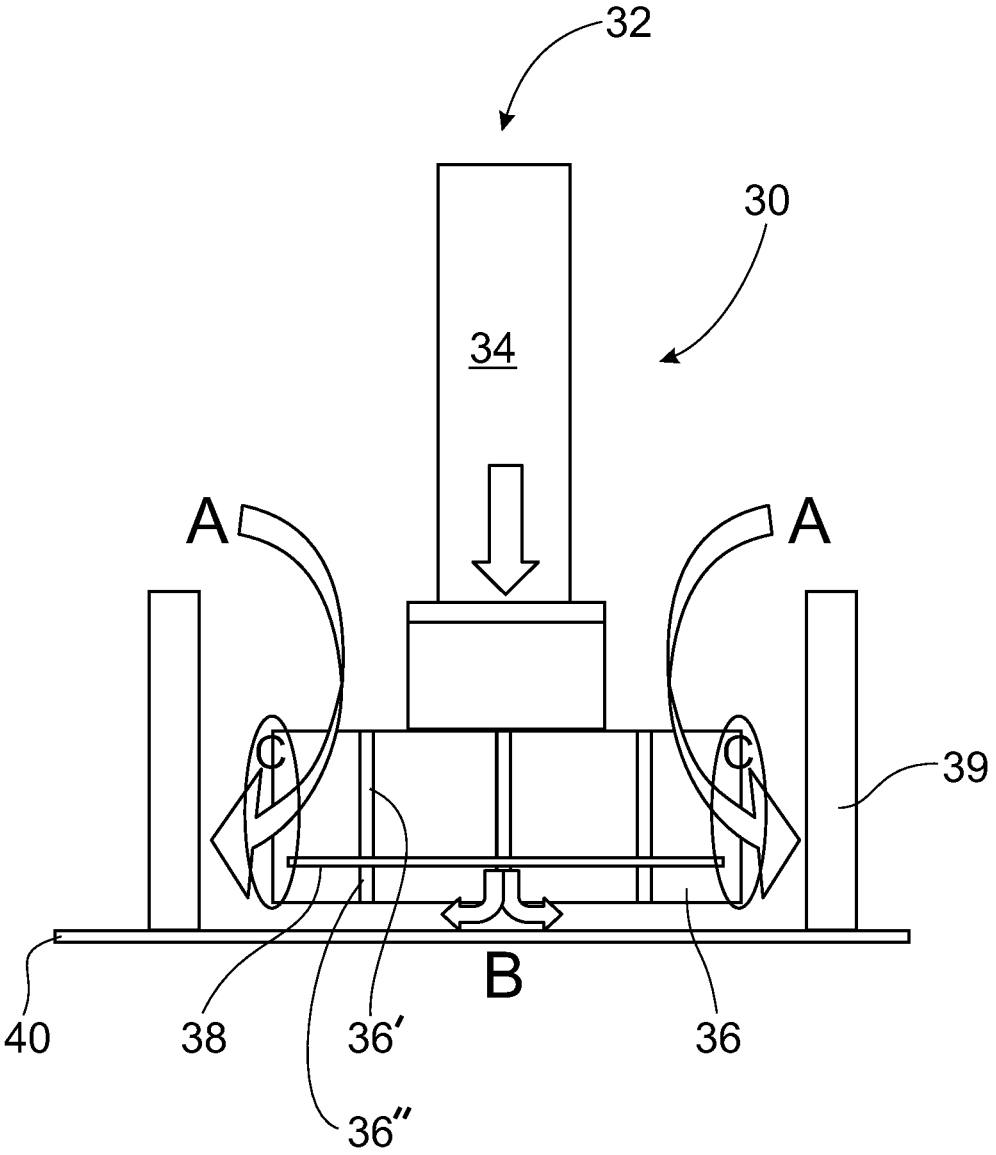
FIG. 1 illustrates a rotor according to an embodiment of the invention in a tank.

Embodiments of the present invention reside primarily in flotation cell rotors for flotation cells. Accordingly, the invention has been illustrated in concise schematic form in the drawings, showing only those specific details that are necessary for understanding the embodiments of the present invention, but so as not to obscure the disclosure with excessive detail that will be readily apparent to those of ordinary skill in the art having the benefit of the present description.

In this specification, adjectives such as first and second, top and bottom, left and right, horizontal and vertical, and the like may be used solely to distinguish one element or action from another element or action without necessarily requiring or implying any actual such relationship or order. Words such as "comprises" or "includes" are intended to define a non-exclusive inclusion, such that a process, method, article, or apparatus that comprises a list of elements does not include only those elements but may include other elements not expressly listed, including elements that are inherent to such a process, method, article, or apparatus.

Figure 2:
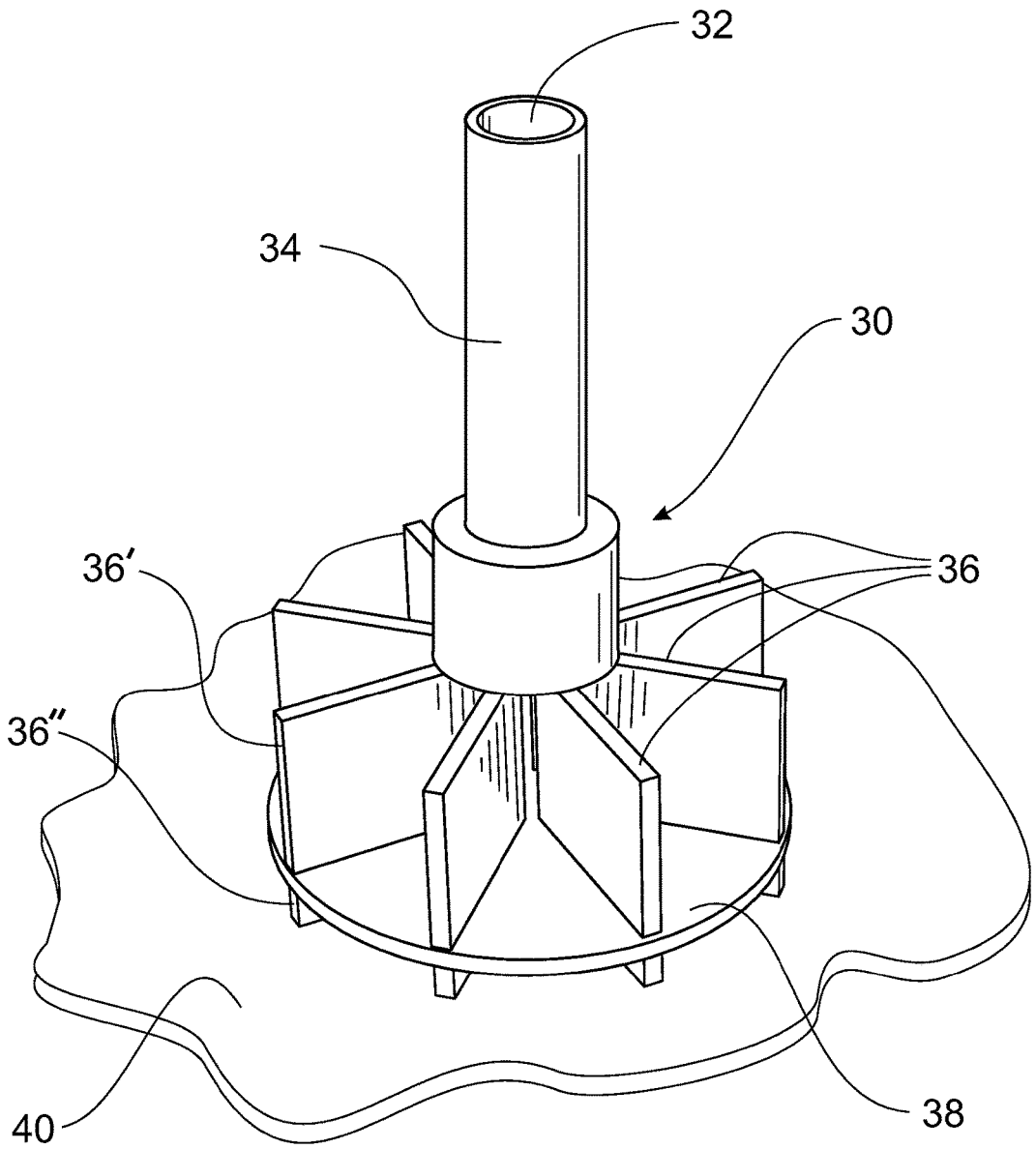
FIG. 2 illustrates a diagrammatic perspective view of the rotor illustrated in FIG. 1.

FIGS. 1 and 2 illustrate a rotor 30 according to an embodiment of the present invention. A shaft 34 defining a conduit 32 therein has an impeller 36 at an end thereof adjacent a floor 40 of the tank. The impeller 36 has a plurality of impeller blades 36' that extend perpendicularly to the shaft axis. Each impeller blade 36' is a substantially rectangular member, extending longitudinally perpendicular to the shaft axis, but in a plane that coincides with the shaft axis. The impeller 36 is generally in the form of a flat cylindrical shape, having a constant diameter over the axial axis of the rotor. The number of impeller blades 36', particularly as illustrated in FIG. 5, is for illustrative purposes only, and it would be appreciated by a person skilled in the art that more or less blades could be provided, as necessary or desired.

A baffle 38 is provided which is adjacent the bottom of the impeller 36. The baffle 38 extends radially from the lower end of the shaft 34 to at or near the outer edge of the impeller blades 36'. The baffle 38 is a generally planar, circular, plate element is substantially perpendicular to the longitudinal axis of the shaft 34. Although the baffle 38 and the impeller blades 36' are both longitudinally perpendicular to the shaft 34, they are in planes which are perpendicular with respect to each other (i.e., the impeller blades 36' are in a generally vertical plane and the baffle 38 is in a generally horizontal plane).

In the illustrated embodiments the baffle 38 is affixed to the shaft and/or one or more of the rotor blades, such that as the impeller 36 rotates, the baffle rotates therewith. In an alternative embodiment (not illustrated) the baffle may be affixed to a portion of the tank, typically some inner surface, so that it is stationary with respect to the impeller 36. In such an embodiment, the baffle 38 is preferably raised off the floor 40 to some degree to allow passage of gas underneath. Alternatively, the baffle 38 may be integrated with the floor 40 and may have one or more gas outlets contained therein.

The conduit 32 is in fluid communication with an outlet adapter to release the fluid below the baffle 38, generally in the region labelled 'B' in the illustrated embodiments. This allows a fluid, preferably a gas, to flow from a source (not illustrated) down through the conduit to the outlet below the baffle where it can subsequently be dispersed in the tank. In the illustrated embodiments, the gas is outlet directly below and central to the baffle 38 as generally indicated by 'B'. The gas then travels along the underside of the baffle 38 to at or near a lower outer edge of the impeller blades 36' where it is dispersed into the slurry being mixed within the tank.

A minority portion 36" of the impeller blades 36' may extend below the baffle 38. As the rotor 30 is positioned in the tank such that the impeller 36 is located adjacent the bottom floor 40 of the tank, the minority portions 36" of the impeller blades 36' preferably function substantially like a scraper. The minority portion 36" of the impeller blades 36' may also provide guidance to the gas being released at 'B' to an outer lower edge of the impeller 36.

In any event, the minority portion 36" should be small enough and close enough to the floor 40 of the tank such that no substantial suction or mixing occurs as shown by flow arrows 'A' in FIG. 2. It will be appreciated, however, that a small flow may inherently be generated by the minority portions 36", but this flow should be significantly less than the flow generated by the upper majority portion of the impeller blades 36'.

In an alternative embodiment (not illustrated) the baffle 38 may be directly adjacent the lower edge of the impeller blades 36' such that the baffle 38 engages with the lower edge of the impeller 36 and no minority portion 36" is provided underneath the baffle 38. In such an embodiment, one or more expeller members, which may not necessarily correspond with the impeller blades 36', may be provided on the underside of the baffle 38.

The rotor 30 is typically made of a metal, e.g. steel. For high wear applications, such as when processing abrasive slurry, the rotor components are coated with a wear resistant coating, such as polyurethane or rubber.

The tank may have one or more stationary members 39 which are adjacent at least an outer circumference of the impeller 36. Preferably there is a plurality of stationary members 39, collectively forming a stator. Such a stator is usually provided to assist in shearing of the gas (from 'B') and agitation of the slurry.

In use, the rotor 30 is rotated in a slurry mixture within a tank. A gas, preferably air, is fed down the conduit 32 of the shaft 34 and is released under the baffle 38, as generally indicated by arrows 'B', in a lower region of the tank near the floor 40. The gas travels along the baffle 38, possibly assisted by centrifugal force and the minority portion 36" of the impeller blades 36', to an outer periphery adjacent a lower outer edge of the impeller blades 36'.

The gas then mixes with the slurry in a bubble contact region generally designated by 'C'. The baffle may also have one or more apertures (not shown) which assist and/or increase the size of the bubble contact region 'C'. The slurry mixture is drawn into the impeller 36 from above, unhindered by the lower located baffle 38, and propelled outwards by the impeller 36 as generally indicated by flow arrows 'A'.

The bubble contact region 'C' for the rotor 30 shown in FIG. 4 is significantly larger than in previous flotation machines. Depending on the rotor configuration, the bubble contact region 'C' of the rotor 30 is typically more than 10 times greater than in prior art systems as the contact area extends the entire outer edge of the rotor 36. As the air is released under the baffle 38, which is adjacent the bottom of the impeller 36, when it reaches the outer edge of the baffle 38 it rises along the outer edge of the impeller 36 creating bubbles along the full height of the impeller 36 and not just in a very small upper region as occurs in prior art systems having a baffle located at the top.

Advantageously, the rotor 30, particularly when adjacent the tank floor 40, improves solids suspension, air dispersion, and circulation. Regarding solids suspension, the impeller 36 draws slurry down from above, where the incoming flows are unrestricted, and creates strong sideways outflows, as illustrated in FIG. 4 by arrows 'A'.

These outflows impart a sweeping action along the floor 40 of the tank, particularly around the periphery of the impeller 36 through, and beyond, the stator 39. The strong sweeping outflows dislodge and carry any settled solids, preventing (or at least significantly reducing) sanding of the tank. Furthermore, as the slurry inflows are drawn downwards, with unhindered passage, into the impeller 36, flows are increased and dead zones within the flotation machine are substantially eliminated or at least greatly reduced.

Finally, by having the gas being released below a baffle 38 located adjacent the bottom of the impeller 36 there is significantly improved air dispersion, as the gas has a significantly increased bubble contact region 'C' where it may be dispersed into the slurry.

The rotor 30 may be installed in a tank during construction or retro-fitted to an existing tank. Either way, but particularly for retro-fitting, the rotor may be provided in the form of a kit which is assembled at site for use as described.

In general, the fluid/gas referred to herein is typically air which is dispersed in the slurry to form gas bubbles which rise to the surface of the slurry within the tank with solids adhered thereto. Once at or near the surface, the bubbles may then be removed for further processing to recover the solids (e.g. ore).

It is to be understood that the terminology employed above is for the purpose of description and, unless explicitly stated otherwise, should not be regarded as limiting.

Where the context permits, reference to an integer or a component or a step (or the like) is not to be interpreted as being limited to only one of that integer, component, or step, but rather could be one or more of that integer, component, or step etc.

Any reference to background or prior art herein is not to be construed as an admission that such art constitutes common general knowledge.

The invention claimed is:

1. A flotation tank assembly comprising:

a tank having a floor and at least one side wall together defining a cavity; and a rotor located adjacent the floor of the tank the rotor comprising:

a shaft having a conduit adapted to communicate a fluid therethrough;

an impeller having a series of impeller blades that extend outwardly around and continuously from the shaft; and a substantially planar baffle located adjacent the bottom of the impeller, the baffle extending transversely with respect to the shaft and extending at least substantially the width of the impeller, wherein the baffle engages with a lower edge of the impeller blades; and wherein the conduit has an outlet located below the baffle.

2. A flotation tank assembly according to claim 1, wherein a minority portion of the impeller blades extend below the baffle.

3. A flotation tank assembly according to claim 1, wherein the baffle is affixed to at least one of: the shaft and one or more of the rotor blades.

4. A flotation tank assembly according to claim 1, wherein the impeller has a constant diameter over the axial axis of the rotor.

5. A flotation tank assembly according to claim 1, wherein each impeller blade is substantially rectangular.

6. A flotation tank assembly according to claim 1, wherein the shaft defines the conduit.

7. A flotation tank assembly according to claim 1, further comprising one or more expeller members below the baffle.

8. A flotation tank assembly according to claim 7, wherein the one or more expeller members are formed from at least a portion of the impeller blades extending below the baffle.

9. A method of dispersing a fluid into a slurry in a flotation cell, the method comprising the steps of:

rotating a rotor located adjacent a floor of a tank containing slurry, the rotor having:

a shaft that has a conduit adapted to communicate a fluid therethrough;

an impeller having a series of impeller blades that extend outwardly around and continuously from the shaft; and at least one substantially planar baffle adjacent the bottom of the impeller, the baffle extending transversely with respect to the shaft and extending at least substantially the width of the impeller;

feeding the fluid through the conduit to an outlet below the baffle; and dispersing the fluid from the outlet adjacent a lower outer edge of the impeller blades;

wherein the fluid is dispersed at a peripheral edge of the baffle below a majority portion of the impeller blades.

10. A flotation tank assembly comprising:

a tank having a floor and at least one side wall together defining a cavity; and a rotor located adjacent the floor of the tank the rotor comprising:

a shaft having a conduit adapted to communicate a fluid therethrough;

an impeller having a series of impeller blades that extend outwardly around and continuously from the shaft; and a substantially planar baffle located adjacent the bottom of the impeller, the baffle extending transversely with respect to the shaft and extending at least substantially the width of the impeller;

wherein the conduit has an outlet located below the baffle;

wherein the impeller blades define free ends at the top of the impeller, the free ends of the impeller blades being in direct contact with the cavity of the tank so that a flow of contents of the cavity may be defined directly from above the free ends which flows across the free ends generally towards the baffle and radially-outwardly through the impeller blades.

* * * * *